United States Patent [19]

Nagel et al.

[11] Patent Number: 4,779,668

[45] Date of Patent: Oct. 25, 1988

[54] TREATMENT OF CAST METAL IN COPE MOLD POURING BASIN

[75] Inventors: Edmund R. Nagel, Saginaw; Thomas J. Gray, Bay City, both of Mich.

[73] Assignee: General Motors Corporation, Detroit, Mich.

[21] Appl. No.: 311,976

[22] Filed: Oct. 16, 1981

[51] Int. Cl.[4] ..... B22D 27/20

[52] U.S. Cl. ..... 164/349; 164/58.1

[58] Field of Search ..... 164/57.1, 123, 133, 164/349, 55.1, 58.1; 75/130 R, 130 A, 130 B

[56] References Cited

U.S. PATENT DOCUMENTS 3,433,293 3/1969 Ponzar ..... 164/358

4,037,643 7/1977 Mohla et al. ..... 164/58.1

4,154,289 5/1979 Jeanneret ..... 164/358

*Primary Examiner*—Nicholas P. Godici

*Assistant Examiner*—Richard K. Seidel

*Attorney, Agent, or Firm*—Elizabeth F. Harasek

[57] ABSTRACT

A method and means are provided for treating molten metal with an additive in a foundry mold. A recessed treatment chamber for an additive is provided in the top of a mold. The chamber is covered with a discrete refractory core body. Molten metal poured on the core body is directed into the chamber where it reacts with the additive before entering the casting cavity. The subject invention is particularly adapted to making nodular or compacted graphite iron castings by treating grey iron with a magnesium containing additive.

2 Claims, 3 Drawing Sheets

TREATMENT OF CAST METAL IN COPE MOLD POURING BASIN

This invention relates to foundry molds wherein the top of the mold is adapted to retain an additive for cast metal. The invention further relates to a controlled method of treating molten metal with desired additives in such foundry molds.

BACKGROUND

In order to obtain castings with desired metallurgical properties, it is at times necessary to treat molten metal with an additive prior to its introduction to the casting cavity of a foundry mold. Herein, the term casting cavity means the cavity portion of a foundry mold in which poured metal solidifies to form useful castings along with the associated runner system. The term excludes the pouring basin and downsprue mold portions unless otherwise noted.

A widely used practice involving the introduction of an additive to molten iron is that used to make nodular or compacted graphite iron from molten iron that would otherwise solidify as grey iron. In grey iron, the graphite precipitates in flake form. In nodular iron, however, the free carbon precipitates in the form of microscopic spheroids or nodules of graphite. Compacted graphite (c.g.) iron has a graphite structure between grey and nodular irons. At least a portion of the free carbon is present in the form of elongated or lamillar type structures.

Nodular and c.g. irons are generally made by treating molten grey iron with an additive containing magnesium in alloyed or elemental form. Within limits well defined in the art, it has been found that a certain amount of retained magnesium (approximately 0.35 weight percent) will produce nodular iron while lesser amounts yield c.g. iron or iron with a mixture of compacted and nodular graphite structures.

Before this invention, molten iron has been treated with magnesium containing additives either in the pouring ladle or the foundry mold. The ladle treatment method is wasteful of expensive additive materials and has inherent processing problems. As a consequence, the inmold inoculation method has become more prevalent. The molds used in this method have at least one chamber for retaining nodularizing additive. The chamber is located downstream of the pouring basin and sprue to prevent the violent reaction which takes place when molten iron contacts magnesium or magnesium alloy in the presence of oxygen. A disadvantage of in-the-mold inoculation has been that the treatment chamber occupies mold space that could otherwise be used for good castings. Extra metal must be poured to assure uniform nodularizing treatment, but metal that solidifies in the treatment chamber is scrap. A further disadvantage to the system is that the chambers are not visible once the cope mold is set on the drag. Once the cope is set, it is impossible to visually determine whether additive has been introduced to a particular mold before or after the iron is poured. Failure to inoculate a mold will produce a grey rather than a nodular iron casting.

A number of solutions have been proposed to circumvent the need for a treatment chamber in the mold. They all involve the use of a separate secondary foundry mold consisting of a pouring basin, downsprue, treatment chamber and outlet. The secondary mold is positioned above the primary mold. The iron is poured directly into the secondary mold and is treated before it reaches the primary mold. See, for example, U.S. Pat. No. 3,819,365 to McCaulay and Dunks.

The use of a secondary treatment mold is undesirable for a number of reasons. Obviously, the manufacture of separate treatment molds is costly. From a processing standpoint, the iron must be poured at an undesirably high temperature to avoid premature solidification in the primary mold. Additional equipment is required to support the secondary mold above the primary mold.

OBJECTS

Therefore, it is an object of the invention to provide a method and means for treating molten metal with an additive in a foundry mold wherein the treatment chamber is located in the cope mold pouring basin so as not to take up mold space preferably occupied by the casting cavity. A more particular object is to provide a method and means of treating molten grey iron with magnesium additives in such mold treatment chamber to produce c.g. or nodular iron castings. Another object is to treat cast metal at normal casting temperatures in a cope mold chamber such that the additive is evenly and nonviolently taken up by the metal at a controlled and determinable rate.

Another object is to adapt the pouring basin of a conventional foundry cope mold to treat metal poured therein with an additive prior to its entry into the casting cavity. More specifically, it is an object to provide a cope mold wherein poured metal is treated in a chamber located in a modified cope pouring basin covered by a specially adapted core member. In the chamber, the flow of metal is controlled to provide for uniform and predictable dissolution of the additive in the metal without violent reaction. Another specific object is to provide a method and means for making nodular and compacted graphite iron by treatment of grey iron with a magnesium additive in such specially adapted cope mold pouring basin.

BRIEF SUMMARY

In accordance with a preferred practice of the invention, these and other objects may be accomplished as follows.

A conventional foundry mold with downsprue, runner and casting cavity portions is provided. Such mold could be used, for example, to make grey iron or ladle treated nodular castings. The pouring basin of the mold is adapted, however, to include at least one recessed treatment chamber for retaining a desired amount of foundry additive. The additive may, e.g., be a metal or metal alloy such as ferrosilicon or magnesium-ferrosilicon in particulate or block form. The size of the chamber is calculated to retain an adequate amount of additive and provide the desired contact area between the poured metal and the additive. Supports are provided at the chamber corners for maintaining a cover core. The core is a refractory mold element shaped to rest on the supports, cover the additive in the open treatment chamber, and direct the flow of iron towards fluid passages between itself and the supports into the chamber. The core cover, supports and chamber are recessed into the cope mold so that cast metal does not run out of the pouring basin at ordinary foundry pour rates.

To make a casting, molten metal is poured directly onto the center of the cover core. The metal flows over the core, the hydraulic pressure of the poured metal keeping it in position on the supports. Runners at the ends of the cover core direct the flow of the metal into the treatment chamber. In the chamber, the metal flows evenly and nonviolently over the surface of the additive and reacts with it. The outlet of the chamber leads to the downsprue. The outlet is dammed to prevent the flow of dross into the casting cavity and is preferably choked with respect to the chamber runner to provide adequate contact time between the molten metal and additive. Thus, metal entering the downsprue is fully treated with additive retained in the cope mold pouring basin.

The subject mold and method eliminate the need for locating a separate treatment chamber in mold space more productively occupied by the casting cavity. Further, no awkward and chill inducing secondary mold is required. The method can be practiced on existing casting lines for grey or nodular iron. The invention is particularly useful on lines with automatic inoculating and pouring equipment. Moreover, the resin bonded sand molds generally used on such lines can be readily modified at little cost to accommodate the modified downsprue treatment chambers and core covers which are at the heart of the invention.

DETAILED DESCRIPTION

Our invention will be better understood in view of the following Figures, detailed description and Examples.

Figure 1:
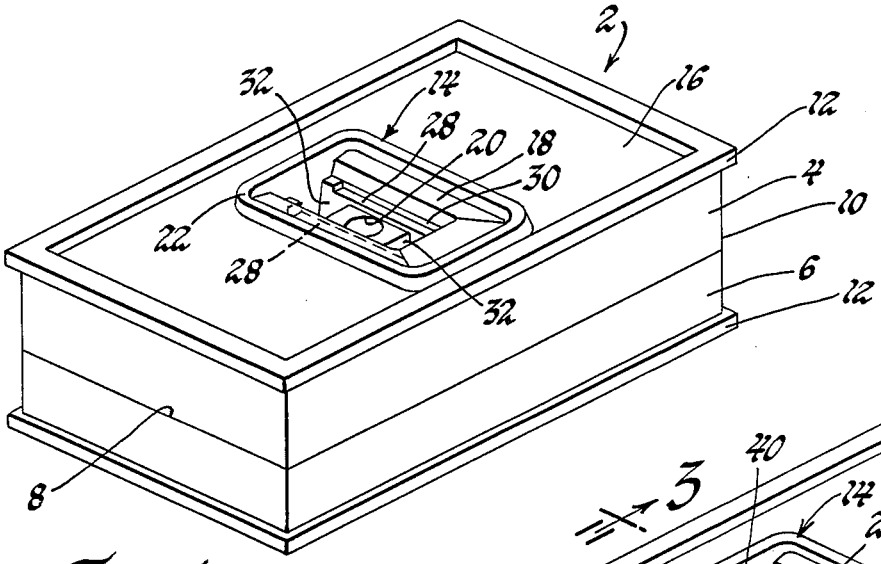
FIG. 1 is a perspective view of a resin bonded sand mold having a specially adapted pouring basin in the cope mold.
Figure 2:
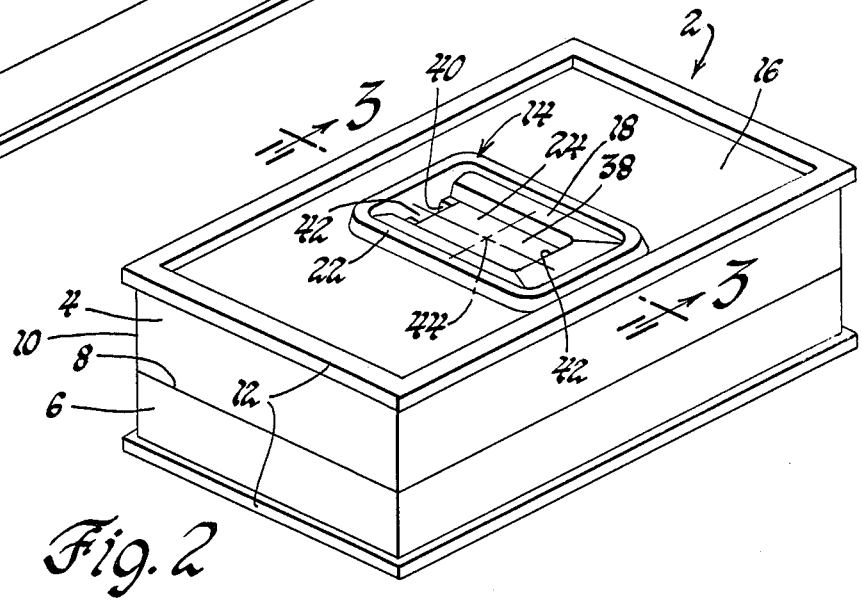
FIG. 2 is a perspective view of the mold of FIG. 1 with a cover core in molding position in the pouring basin.

Referring now to FIGS. 1 and 2, a mold 2 is shown that would be suitable for the practice of the invention. Mold 2 has cope mold portion 4 (cope) and drag mold portion 6 (drag) which meet along parting line 8. A preferred mold material is resin bonded silica sand. The subject molds may be made by conventional practices described generally in the Molding and Casting Processes section,Patterns for Sand Molding and Sand Molding subsections, Volume 5 of the *Metals Handbook,* 8th edition, pages 149–180. In a preferred mold making process a cope or drag pattern (not shown) is positioned with respect to a core flask 10 with a support flange 12. Resin impregnated sand is squeezed into the flask around the pattern. The pattern is withdrawn and after the binding resin has been cured, cope 4 is set on the drag 6 as seen at FIG. 1.

Figure 3:
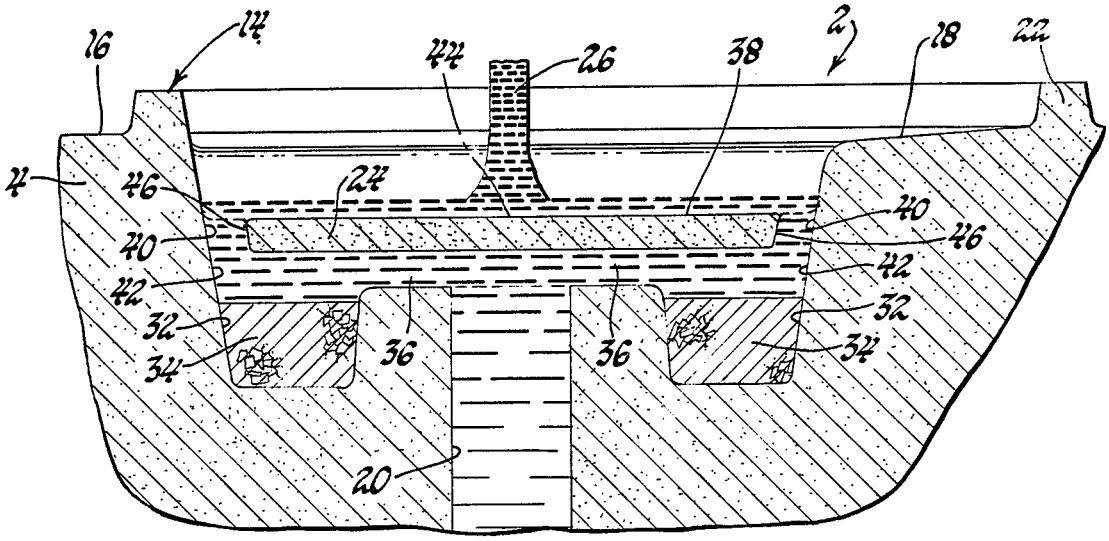
FIG. 3 is a partial sectional view along 3—3 of FIG. 2 showing the cover core, treatment chambers, chamber runners, pouring basin, downsprue and other features of the cope mold during a pour.

The subject invention depends on the presence and use of a specialized pouring basin 14 in the top 16 of cope 4. Preferably, the pouring basin is integrally formed with the cope mold. Herein the term pouring basin defines a depression in the top of a cope mold which depression is adapted to receive molten metal before it enters the downsprue or downgate. In a conventional mold, the pouring basin generally has smooth, downwardly sloping walls which terminate at the inlet of the downsprue. It serves to directly receive poured metal and is sized to retain enough metal to prevent spillage at ordinary pour rates. Pouring basin 14 shown at FIGS. 1–3 is a characteristic embodiment of the greatly modified pouring basins of my invention. This improved pouring basin serves not only to retain poured metal, but also to treat it with foundry additive in a controlled manner. For example, the subject invention provides a reliable and inexpensive means of treating grey iron with volatile magnesium additives in a mold without sacrificing mold space better utilized for the casting cavity.

Referring now to FIGS. 1 to 3, walls 18 of pouring basin 14 slope downwardly towards the sprue 20 from elevated lip 22. Lip 22 projects from top surface 16 of cope 4. Walls 18 in conjunction with lip 22 and cover core 24, form a basin for molten metal immediately after it is poured.

Cover core 24 rests on ledges 28 and fits tightly with respect to vertically oriented portions 30 of walls 18. FIG. 2 shows cover core 24 in position for casting seated on ledges 28. Between ledges 28 are two recessed chambers 32 for retaining a particulate additive 34. Referring to FIG. 3, it can be seen that chambers 32 are symmetrical and in a line with one another that bisects the sprue 20. The chambers are deep enough so that the level of additive 34 is below the level of chamber outlet runners 36 to the sprue 20. This prevents additive 34 from washing into the casting cavity. When core cover 24 is set as shown at FIGS. 2 and 3, molten metal 26 poured onto it flows over its top surface 38 through inlet runners 40. These runners are formed between core cover 24 and the ends 42 of treatment chambers 32 most remote from sprue 20. Runners 40 are sized to allow free flow of poured metal therethrough at a predeterminable rate. Outlet runners 36 are generally choked with respect to inlet runners 40 to maintain contact between molten metal 26 and additive 34 for a time sufficient for a controlled amount of additive to be taken up. The molten metal is preferably poured onto center 44 of cover core 24 so it does not tilt.

Referring to FIG. 3, the flow path of metal 26 is from a pouring ladle (not shown) onto cover core 24, through the inlet runners 40, over additive 34 in chambers 32, through outlet runners 36 and into sprue 20. By the time it reaches sprue 20, the metal is fully treated with the chosen additive to achieve the desired metallurgical result.

Referring again to FIGS. 2 and 3, it is important that cover core 24 be thick enough to withstand the force of poured metal without damage. As noted above, it is preferable to pour the metal directly onto the center of the core cover. However, the cover core itself should be designed and seated in the pouring basin so that it will not be readily tipped or dislocated if metal is not poured exactly on center. Cover core 24 may be formed of mold sand or any other suitable refractory material. Cover cores made of sturdy refractory materials may be re-used.

It will be apparent to one skilled in the art that the cope molds of the subject invention can be made from relatively simple patterns with ordinary mold making equipment.

The following examples relate to casting trials run with sand molds having pouring basins like those shown in FIGS. 1–3. The trial casting was an automotive exhaust manifold of the type sketched at FIG. 4. Ten manifolds were cast in each mold, the cavities being located at the mold parting line and arrayed as shown in FIGS. 5 and 6. The poured iron was treated with a magnesium additive to achieve a nodularity of at least about 40% of the total graphite. The cross at the center of the molds indicates the location of downsprue 20.

MOLD DESIGN

The trials were run with a sand mold designed to cast grey iron manifolds having a pouring basin modified in accordance with the invention. Calculations were made to approximate the dimensions for the treatment chambers. The calculations were based on prior experience with in-the-mold inoculation where the treatment chambers were located inside the mold along the mold parting line.

For the exhaust manifold mold of FIGS. 5 and 6, the approximate poured iron weight was 165 pounds and the pour time with automatic pouring equipment, about 9 seconds. The pour rate (R) is equal to the metal weight divided by the pour time or 18.33 pounds per second.

The inoculants to be used were sized 5% magnesium—50% silicon ferrosilicon alloy particles and 50% silicon ferrosilicon particles homogenously mixed with 5 weight percent elemental magnesium particles. Herein the term inoculant refers to a foundry additive for molten iron used to effect the microstructure of the carbon phase in a cooled casting. The rates (S) at which these inoculants dissolve in poured iron are substantially equivalent and were estimated to be about 2.00 pounds per sec-inch$^2$ contact area.

The calculated desired cross-sectional area of the reaction chamber at mid-depth of inoculant (Y) would be equal to the pour rate (R) divided by the solution rate (S) or $$Y = \frac{R}{S} = \frac{18.33 \text{ lbs/sec}}{2.00 \text{ lbs/sec-inch}^2} = 9.16 \text{ inch}^2$$

The amount of inoculant required to achieve 40% nodularity by in-the-mold inoculation is about 0.45% of the total cast iron weight. Extra-polating the assumption that the subject process is comparable, then the amount of inoculant required would be $$Q = 0.0045 \times 165 \text{ lbs} - 0.74 \text{ lbs}$$

The inoculant density (G) being about 0.076 lbs/inch$^3$, the required volume of inoculant would be its weight (Q) divided by its density (G) or $$V = \frac{Q}{G} = \frac{0.74 \text{ lbs}}{0.076 \text{ lbs/inch}^3} = 9.74 \text{ inch}^3$$

The total depth (H) of inoculant in the chamber would be equal to its volume (V) divided by its cross sectional are at mid-depth inoculant (Y) or $$H = \frac{V}{Y} = \frac{9.74 \text{ inch}^3}{9.16 \text{ inch}^2} = 1.06 \text{ inch}$$

A cope mold pattern was designed based on these calculations. Referring again to FIG. 3, walls 42 of chambers 32 were provided with a 10° draft angle from the vertical. The other three chamber walls and edges 46 of cover core 24 were provided with a 5° draft angle. Sprue 20 had a right circular cylindrical shape with a diameter of 2 inches and a circular cross sectional area of 3.14 inch$^2$. The combined cross sectional area of runners 40 into chambers 32 was equal to the cross sectional area of the downsprue, each runner 40 having a cross sectional area of 3.14/2 or 1.57 inch$^2$. The combined cross sectional area of chamber outlet runners 36 was choked ten percent with respect to the sprue area totalling $0.9 \times 3.14$ inch$^2 = 2.83$ or 1.41 inch$^2$ per outlet runner.

The area of each reaction chamber at the bottom 48 was $2.25 \times 1{:}82$ inch$^2$: at mid depth of inoculant $2.39 \times 1.91$ inch$^2$: and at the top of the inoculant $2.53 \times 2.01$ inch$^2$. The surface of the inoculant was 0.75 inch below the runner 36. The cover core was sized to rest on ledges 28 and fit snugly into the core cover print as shown at FIG. 2. The core cover was formed of resin bonded sand and was approximately 0.5 inch thick.

EXAMPLE I

Figure 4:
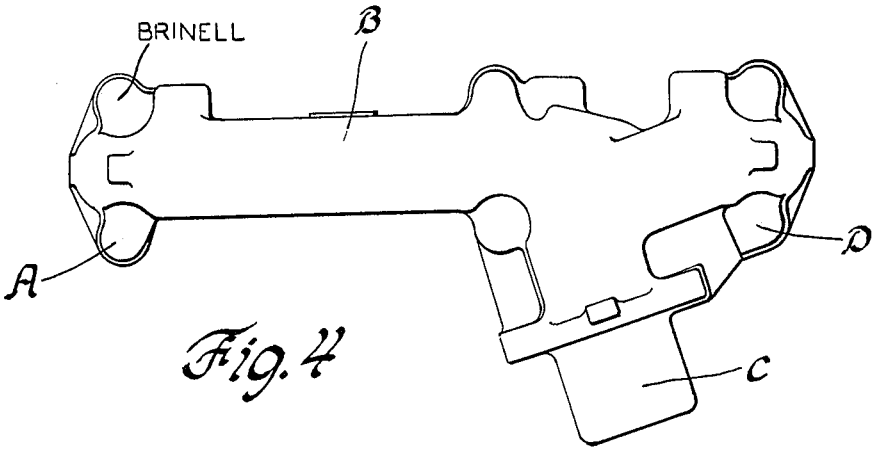
FIG. 4 is a sketch of an automotive engine exhaust manifold casting indicating the areas which were analyzed for carbon nodularity and Brinell hardness.
Figure 5:
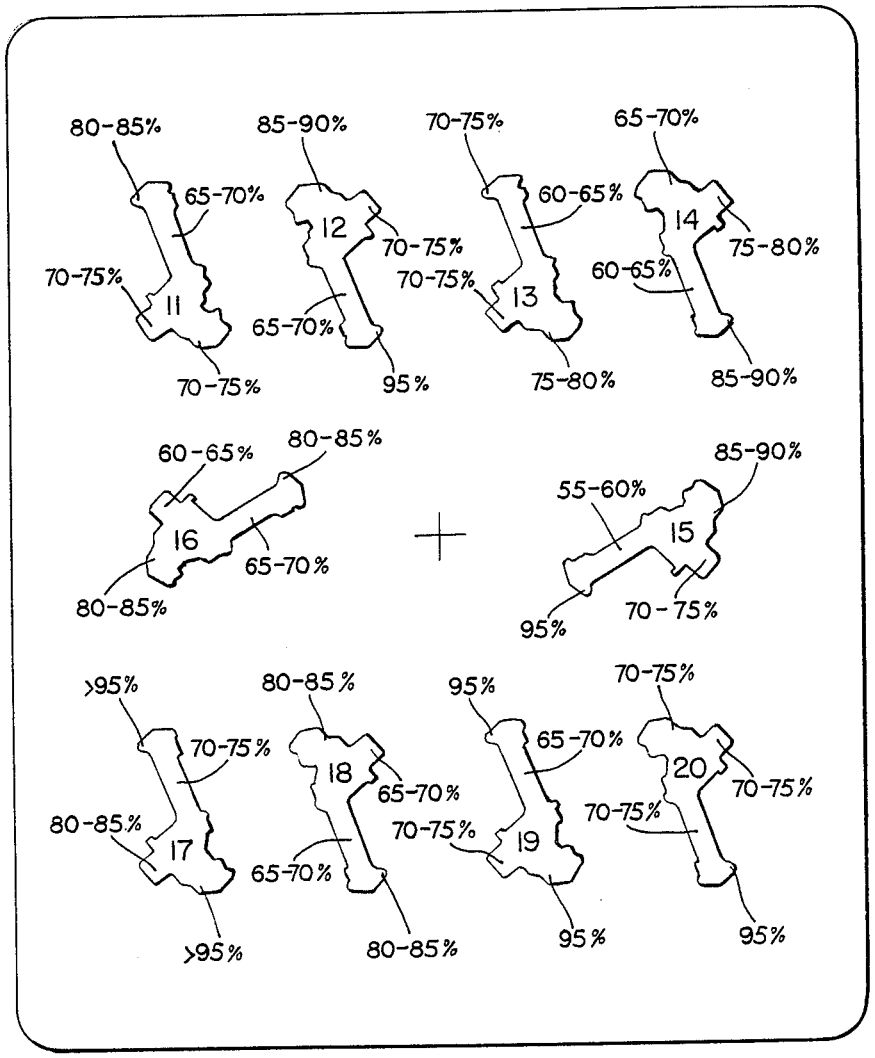
FIGS. 5 and 6 are schematic layouts of tengang molds for the automotive exhaust manifold of FIG. 4 poured in accordance with subject means and method.
Figure 6:
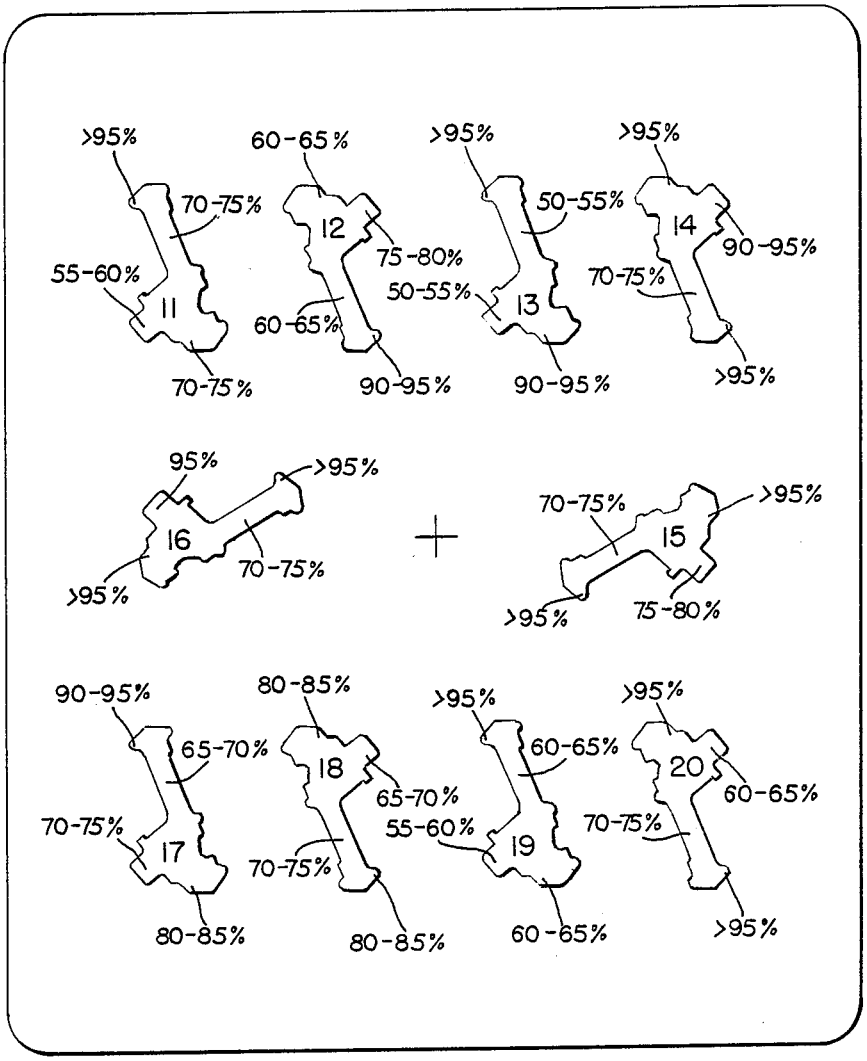

Exhaust manifold castings of the type shown in FIG. 4 were made in accordance with the subject invention in molds with the casting cavity layout shown in FIG. 5.

A pattern for the modified cope mold pouring basin was mounted on the squeeze head of conventional sand mold making equipment. The molds were made from resin bonded sand. After the resin binder had been cured, the cope mold was set on the drag mold.

In accordance with the calculations set forth above, 0.37 pounds of inoculant was added to each cope mold chamber. The additive employed was a particulate mixture consisting of chips of 50% silicon-ferrosilicon alloy and 5% elemental magnesium nodules of the type described in U.S. Pat. No. 4,224,069 assigned to the assignee hereof. After the inoculant was introduced, the cover core was set on each mold as shown in FIG. 2.

In all, 13 molds were poured. Desulfurized iron was used, the iron chemistry for the pour being within the desired operating ranges of 3.9–4.0 weight percent carbon; 0.3–0.4 weight percent manganese, and less than 0.08 weight percent sulfur.

The pour time for casting 165 pounds iron by means of automatic pouring equipment was 9.9 seconds per mold. This pour rate was slower than the 9.0 seconds pour time on which our calculations were based. The pour temperature of the iron was 2470° F. The preferred pour temperature range is 2550°–2700° F. Because of the low pour temperature, some cold shuts were experienced in the molds. A cold shut is a location where iron solidifies a thin section of the casting or runner before it is properly knit with incoming iron. Castings with cold shuts were scrapped.

The poured iron was allowed to solidify in the mold at room temperature and the solidified castings were shaken out after about 45 minutes.

The iron was poured on the center of the cover core in each mold. The hydraulic pressure of the molten iron on top of the core prevented it from floating on the iron underneath it in the reaction chambers. Lateral movement of the core is prevented by the walls of the core print in which it rests. The core print is the indentation formed in the cope mold above the reaction chambers in which the cover core is seated.

In the subject invention it is the novel design of the pouring basin reaction chambers and the cover core which prevent any simultaneous contact between the molten iron, air and magnesium additive. This provides for a nonviolent reaction between the iron and the magnesium.

At the end of each pour, the core cover floated. While this would be unacceptable during the pour, it did not interfere with the nodularizing process. A momentary flash was noted as the last iron entered the additive chamber, indicating that nodularizing additive was left in the mold. This flash can be advantageously looked for as insurance that a particular pour has been fully treated with a nodularizing additive.

Referring now to FIGS. 4 and 5, one of each of the ten castings poured as above was randomly selected from different molds and analyzed for hardness and nodularity. A Brinell hardness test was run in the area so marked at FIG. 4. Cross sections were cut through the castings in the areas marked A, B, C and D. B is the location of the runner inlet. Sections A and D are both bosses.

The percent nodularity of the castings was determined as follows. A sample was cut from the casting with a band saw. The surface of the sample to be examined was then polished with four progressively finer grades of sandpaper. The surface was then buffed on a buffing wheel with a diamond paste. It was then placed under a metallurgical microscope at a magnification great enough to clearly see the nodular graphite. The graphite is darker than the ferritic iron background. The percent nodularity was estimated by noting what percentage of the carbon formations had a shape ranging from spherical to oblong with the longer side being no more than twice the length of the shorter side. The balance of the graphite was observed to be compacted or lamillar in structure. This percentage of nodular graphite is referred to herein as the percent nodularity. The desired nodularity range for the trial was at least 40%, (i.e., at least 40% of the graphite to be in spherical form and the balance in vermicular form).

Referring to FIG. 5, there were ten castings in each mold. One of each pattern number (11–20 inclusive) was randomly selected from the molds cast and samples were cut and tested for nodularity in areas A, B, C and D. FIG. 5 indicates the observed percent nodularity of the samples at each location. Table I lists nodularities as well as the Brinell hardness taken in the Brinell hardness test area shown in FIG. 4. All Brinell hardnesses were in the desired range of about 4.0 to 4.7.

The nodularity of these castings was higher than hoped for, but above the minimum desired nodularity of 40%. It is clearly within the skill of the art to increase or decrease the amount of nodularity in accordance with this method by varying any of several parameters of the casting process. For example, the contact area between the poured metal and the nodularizing additive in the chambers can be decreased to lower percent nodularity. Alternatively, chamber contact area can be increased to increase the amount of nodularity. The pour rates and temperatures may also be varied.

This example clearly shows that the subject cope mold pouring basin can be successfully employed to make nodular and c.g. iron castings by treating molten grey iron. This being one of the harshest tests for an inoculating process in the mold, the subject method and means are clearly adaptable to treating molten cast metal with other additives less volatile than magnesium by like method and means.

TABLE I

| Pattern Number | Test Area | Percent Nodularity | Brinell Hardness (mm) |
|---|---|---|---|
| 11 | A | 80–85% | 4.25 |
| | B | 65–70% | |
| | C | 70–75% | |
| | D | 70–75% | |
| 12 | A | 95% | 4.15 |
| | B | 65–70% | |
| | C | 70–75% | |
| | D | 85–90% | |
| 13 | A | 70–75% | 4.20 |
| | B | 60–65% | |
| | C | 70–75% | |
| | D | 75–80% | |
| 14 | A | 85–90% | 4.20 |
| | B | 60–65% | |
| | C | 75–80% | |
| | D | 65–70% | |
| 15 | A | 95% | 4.15 |
| | B | 55–60% | |
| | C | 70–75% | |
| | D | 85–90% | |
| 16 | A | 80–85% | 4.25 |
| | B | 65–70% | |
| | C | 60–65% | |
| | D | 80–85% | |
| 17 | A | >95% | 4.20 |
| | B | 70–75% | |
| | C | 80–85% | |
| | D | >95% | |
| 18 | A | 80–85% | 4.25 |
| | B | 65–70% | |
| | C | 65–70% | |
| | D | 80–85% | |
| 19 | A | 95% | 4.20 |
| | B | 65–70% | |
| | C | 70–75% | |
| | D | 95% | |
| 20 | A | 95% | 4.25 |
| | B | 70–75% | |
| | C | 70–75% | |
| | D | 70–75% | |
| AVERAGE | A | 85–90% | 4.21 |
| | B | 65–70% | |
| | C | 70–75% | |
| | D | 80–85% | |

EXAMPLE II

A second trial was conducted as above with the following modifications.

The area of the treatment chamber at mid-depth of alloy was altered from 9.13 square inches to 8.25 square inches. The pour time was extended from 9.9 to 10.2 seconds. The iron was poured at a temperature of 2700° F., the upper limit of the desirable pour temperature range. No cold shuts occurred in any of the cast molds. Thirteen molds were poured. The Brinell hardness and nodularity of the castings were determined as noted above. The results are shown at FIG. 6 and in Table II.

Again, the nodularity of the castings was higher than hoped for. This could be due to a greater efficiency brought about by the subject mold design and method. That is, a greater percentage of the magnesium taken up by the poured iron remains in the cooled casting than in other inoculation methods.

TABLE II

| Pattern Number | Test Area | Percent Nodularity | Brinell Hardness (mm) |
|---|---|---|---|
| 11 | A | >95% | 4.10 |
| | B | 70–75% | |
| | C | 55–60% | |

TABLE II-continued

| Pattern Number | Test Area | Percent Nodularity | Brinell Hardness (mm) |
|---|---|---|---|
| | D | 70–75% | |
| 12 | A | 90–95% | 4.20 |
| | B | 60–65% | |
| | C | 75–80% | |
| | D | 60–65% | |
| 13 | A | >95% | 4.25 |
| | B | 50–55% | |
| | C | 50–55% | |
| | D | 90–95% | |
| 14 | A | >95% | 4.10 |
| | B | 70–75% | |
| | C | 90–95% | |
| | D | >95% | |
| 15 | A | >95% | 4.25 |
| | B | 70–75% | |
| | C | 75–80% | |
| | D | >95% | |
| 16 | A | >95% | 4.20 |
| | B | 70–75% | |
| | C | 95% | |
| | D | >95% | |
| 17 | A | 90–95% | 4.15 |
| | B | 65–70% | |
| | C | 70–75% | |
| | D | 80–85% | |
| 18 | A | 80–85% | 4.20 |
| | B | 70–75% | |
| | C | 65–70% | |
| | D | 80–85% | |
| 19 | A | >95% | 4.15 |
| | B | 60–65% | |
| | C | 55–60% | |
| | D | 60–65% | |
| 20 | A | >95% | 4.15 |
| | B | 70–75% | |
| | C | 60–65% | |
| | D | >95% | |
| AVERAGE | A | 90–95% | 4.18 |
| | B | 65–70% | |
| | C | 70–75% | |
| | D | 80–85% | |

One of the great advantages of the invention over the traditional in-the-mold inoculation process is a weight saving in poured metal. We estimated a savings of 7.5 pounds of metal per mold with the manifold casting of the Examples when the subject method is used in lieu of conventional in-the-mold inoculation. Furthermore, the subject invention allows for greater ganging of useful castings at the mold parting line because of the location of our treatment chamber in the top of the cope mold.

With our method it is easy to determine whether or not a particular pour has been fully treated with a magnesium additive by the characteristic flash at the end of the pour. This flash is caused by a momentary reaction of the magnesium, iron and air. It indicates that a portion of the inoculant remains in the chamber at the end of the pour and that sufficient additive was in the chamber to treat all the poured iron.

Further, molds with our modified pouring basins can be made with conventional sand mold making equipment using relatively simple patterns. All-in-all, the method and the molds described herein provide metal casters with a viable way of reducing costs and increasing productivity when treating molten metal with foundry additives.

While our invention has been described in terms of specific embodiments thereof, other forms may be readily adapted by those skilled in the art. Accordingly, our invention is to be limited only by the following claims.

The embodiments of the invention in which an exclusive property or privilege is claimed are defined as follows:

1. A bonded sand refractory mold in combination with a volatile particulate magnesium additive for the manufacture of nodular iron castings, said mold comprising complementary cope and drag portions having at least one casting cavity located between said cope and drag; a pouring basin impressed in the top of the cope comprising at least one chamber containing a said magnesium additive, a ledge located above and spaced apart from said chamber and walls sloping upwardly and outwardly from said ledge to a lip formed around the basin; a discrete refractory cover core which rests on said ledge such that molten iron poured thereon is retained by the basin walls and flows sequentially over the cover core through at least one runner formed between said cover core and said pouring basin, over the additive in said chamber and thereafter to said casting cavity.

2. A foundry mold having a casting cavity formed between complementary cope and drag mold portions in which mold a pouring basin is impressed in the top of the cope and which basin is specially adapted for the treatment of cast metal with a foundry additive before said metal flows to the casting cavity, said pouring basin comprising at least one chamber suitable for containing a said additive; a ledge located above and spaced apart from said chamber; walls sloping upwardly and outwardly from said ledge; and a discrete refractory cover core which is sized and shaped to rest on said ledge such that metal poured thereon flows first through said chamber and thereafter to said casting cavity.

* * * * *